US008434430B2

(12) United States Patent
Maryamchik et al.

(10) Patent No.: US 8,434,430 B2
(45) Date of Patent: May 7, 2013

(54) IN-BED SOLIDS CONTROL VALVE

(75) Inventors: Mikhail Maryamchik, Fairlawn, OH (US); Kiplin C. Alexander, Wadsworth, OH (US); Mark C. Godden, Mogadore, OH (US); David L. Kraft, Massillon, OH (US)

(73) Assignee: Babcock & Wilcox Power Generation Group, Inc., Barberton, OH (US)

( * ) Notice: Subject to any disclaimer, the term of this patent is extended or adjusted under 35 U.S.C. 154(b) by 856 days.

(21) Appl. No.: 12/570,823

(22) Filed: Sep. 30, 2009

(65) Prior Publication Data

US 2011/0073049 A1 Mar. 31, 2011

(51) Int. Cl.
*F23C 10/20* (2006.01)

(52) U.S. Cl.
USPC ..... 122/4 D; 165/104.16

(58) Field of Classification Search ..... 122/4 D, 122/31.1, 33, 34; 165/104.16; 110/234, 110/245
See application file for complete search history.

(56) References Cited

U.S. PATENT DOCUMENTS

| | | | | | |
|---|---|---|---|---|---|
| 5,140,950 | A * | 8/1992 | Abdulally | 122/4 D |
| 5,239,946 | A * | 8/1993 | Garcia-Mallol | 122/4 D |
| 5,332,553 | A * | 7/1994 | Hyppanen | 422/147 |
| 5,347,953 | A * | 9/1994 | Adbulally | 122/4 D |
| 5,347,954 | A * | 9/1994 | Dietz | 122/4 D |
| 5,406,914 | A * | 4/1995 | Hyppanen | 122/4 D |
| 5,526,775 | A * | 6/1996 | Hyppanen | 122/235.11 |
| 5,533,471 | A * | 7/1996 | Hyppanen | 122/4 D |
| 6,336,500 | B2 * | 1/2002 | Hyppanen | 165/96 |
| 6,532,905 | B2 * | 3/2003 | Belin et al. | 122/4 D |
| 6,631,698 | B1 * | 10/2003 | Hyppanen et al. | 122/4 D |

* cited by examiner

*Primary Examiner* — Gregory A Wilson
(74) *Attorney, Agent, or Firm* — Eric Marich

(57) ABSTRACT

A circulating fluidized bed (CFB) boiler comprising a reaction chamber. A bubbling fluidized bed (BFB) is contained within an enclosure within the lower portion of the reaction chamber and contains an in-bed heat exchanger (IBHX) that occupies part of the reaction chamber floor. At least one non-mechanical valve, which includes an opening between the CFB and BFB and independently controlled fluidizing means located both upstream and downstream of the opening, is used to control the heat transfer to the IBHX by controlling the solids discharge from the BFB to the CFB. The elevation of the bottom of the opening is at or above the elevation of the fluidizing means. A flow control barrier may be located downstream of the opening.

16 Claims, 3 Drawing Sheets

IN-BED SOLIDS CONTROL VALVE

FIELD AND BACKGROUND OF THE INVENTION

1. Field of the Invention

The present invention relates generally to the field of circulating fluidized bed (CFB) reactors or boilers such as those used in industrial or electric power generation facilities and, in particular, to a non-mechanical valve for controlling solids discharge from an in-bed heat exchanger (IBHX) to the CFB.

2. Description of the Related Art

U.S. Pat. No. 6,532,905 to Belin et al. describes a CFB boiler with controllable IBHX. The boiler comprises a CFB reaction chamber as well as a bubbling fluidized bed (BFB) heat exchanger located inside the reaction chamber. Heat transfer in the heat exchanger is controlled by means of controlling the rate of solids discharge from the lower part of the BFB into the reaction chamber. In one embodiment, the discharge control is accomplished using at least one non-mechanical valve that is controlled via the supply of fluidizing gas in the vicinity of the valve.

Another method for controlling the heat transfer is disclosed in U.S. Pat. No. 6,532,905. In this instance, heat transfer is controlled by using one or more conduits extending from a lower part of a BFB to an upper level at or above the lowest portion of the walls forming an IBHX enclosure. By fluidizing the solids particles in the conduit, their upward movement through the conduit is promoted, causing the solids particles to be discharged from the BFB into the surrounding CFB. By controlling the fluidizing gas flow rate, or the number of conduits in operation, the overall solids discharge from the BFB to the CFB is controlled, thus controlling heat transfer in the IBHX.

The higher the capacity of the CFB boiler and/or its exit steam parameters, the higher is the required heat duty of its IBHX. This is even more pronounced in an oxy-firing CFB boiler with elevated oxygen concentration, where the required heat duty of an IBHX for a given reaction chamber size increases drastically resulting in the increased height of the IBHX. Due to higher density of the BFB versus CFB, pressure differential across the non-mechanical valve may reach tens of inches of water column resulting in a high velocity of solids discharge through the valve and overall high flow rate of discharge. The latter may exceed a required rate of solids throughput and thus can adversely affect the controllability of the heat transfer. High solids velocity in the vicinity of the solids control valve may cause erosion of any adjacent tubes of the heating surface in the heat exchanger, as well as erosion of the bubble caps in the CFB reaction chamber in the wake of the jet from the valve.

Given the above, a need exists for a solids control valve that improves the operability and reliability of a CFB boiler where such a boiler contains a controllable IBHX.

SUMMARY OF THE INVENTION

The present invention improves operability and reliability of the CFB boiler with controllable IBHX utilizing at least one non-mechanical valve for controlling solids discharge from the IBHX into the CFB reaction chamber.

Accordingly, one aspect of the present invention is drawn to a circulating fluidized bed (CFB) boiler comprising: a CFB reaction chamber having side walls and a grid defining a floor at a lower end of the CFB reaction chamber for providing fluidizing gas into the CFB reaction chamber; a bubbling fluidized bed (BFB) located within a lower portion of the CFB reaction chamber and being bound by enclosure walls and the floor of the CFB reaction chamber; at least one controllable in-bed heat exchanger (IBHX), the IBHX occupying part of the reaction chamber floor and being surrounded by the enclosure walls of the BFB; and at least one non-mechanical valve designed to permit the control of solids discharge from the BFB into the CFB reaction chamber, the valve including at least one opening in the enclosure wall of the BFB, at least one independently controlled first fluidizing means located upstream of the at least one opening in the enclosure wall, at least one independently controlled second fluidizing means located downstream of the at least one opening in the enclosure wall, wherein the elevation of the bottom of the at least one non-mechanical valve opening in the enclosure wall being at or above the top of both of the independently controlled first and second fluidizing means.

Another aspect of the present invention is drawn to a circulating fluidized bed (CFB) boiler comprising: a CFB reaction chamber having side walls and a grid defining a floor at a lower end of the CFB reaction chamber for providing fluidizing gas into the CFB reaction chamber; a bubbling fluidized bed (BFB) located within a lower portion of the CFB reaction chamber and being bound by enclosure walls and the floor of the CFB reaction chamber; at least one controllable in-bed heat exchanger (IBHX), the IBHX occupying part of the CFB reaction chamber floor and being surrounded by the enclosure walls of the BFB; and at least one non-mechanical valve designed to permit the control of solids discharge from the BFB into the CFB reaction chamber, the valve including at least one opening in the enclosure wall of the BFB, at least one independently controlled first fluidizing means located upstream of the at least one opening in the enclosure wall, at least one independently controlled second fluidizing means located downstream of the at least one opening in the enclosure wall, wherein the elevation of the bottom of the at least one non-mechanical valve opening in the enclosure wall being at or above the top of both of the independently controlled first and second fluidizing means, wherein the at least one IBHX is selected from one or more of a superheater, a reheater, an economizer or an evaporative surface, and wherein the tubes of the at least one IBHX are protected by a layer of erosion-resistant material formed on the surface of the tubes in the vicinity of the at least one opening.

The various features of novelty which characterize the invention are pointed out with particularity in the claims annexed to and forming a part of this disclosure. For a better understanding of the invention, its operating advantages and specific benefits attained by its uses, reference is made to the accompanying drawings and descriptive matter in which exemplary embodiments of the invention are illustrated.

DESCRIPTION OF THE INVENTION

The present invention relates generally to the field of circulating fluidized bed (CFB) reactors or boilers such as those used in industrial or electric power generation facilities and, in particular, to a non-mechanical valve for controlling solids discharge from an in-bed heat exchanger (IBHX) to the CFB.

In the case of oxy-combustion, which typically implies using instead of air an oxidizing agent with increased oxygen concentration, typically comprised predominantly of oxygen and recycled flue gas, the terms "primary air" and "secondary air" should correspondingly be substituted with the terms "primary oxidant" and "secondary oxidant."

As used herein, the term CFB boiler will be used to refer to CFB reactors or combustors wherein a combustion process takes place. While the present invention is directed particularly to boilers or steam generators which employ CFB combustors as the means by which the heat is produced, it is understood that the present invention can readily be employed in a different kind of CFB reactor. For example, the invention could be applied in a reactor that is employed for chemical reactions other than a combustion process, or where a gas/solids mixture from a combustion process occurring elsewhere is provided to the reactor for further processing, or where the reactor merely provides an enclosure where particles or solids are entrained in a gas that is not necessarily a byproduct of the combustion process.

Figure 1:
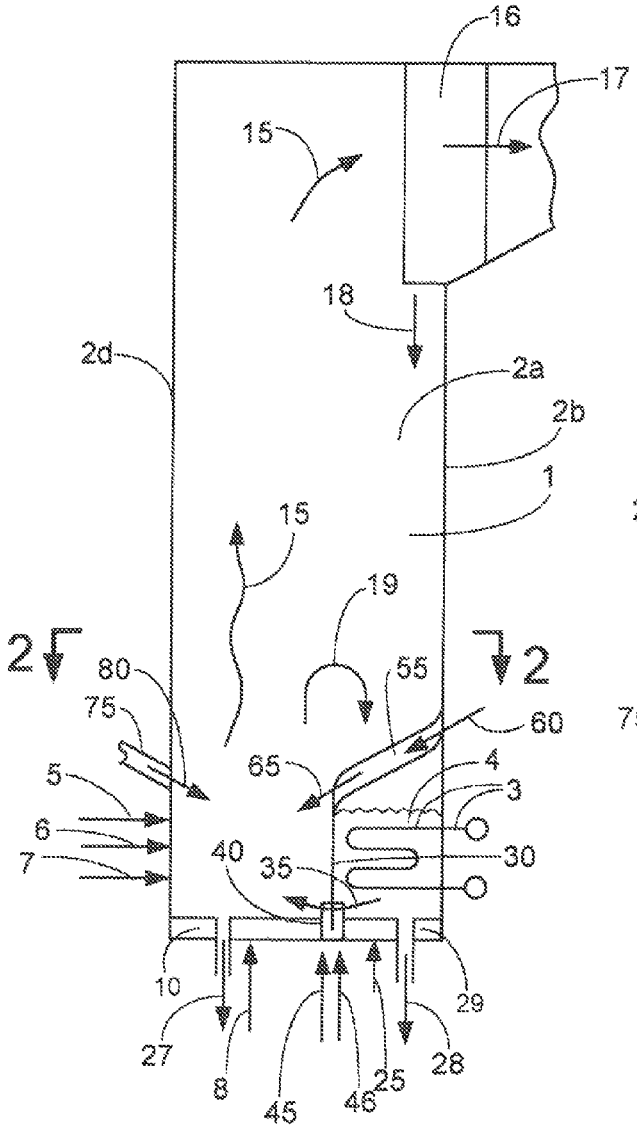
FIG. 1 is a sectional side elevational view of a CFB boiler according to the invention.
Figure 2:
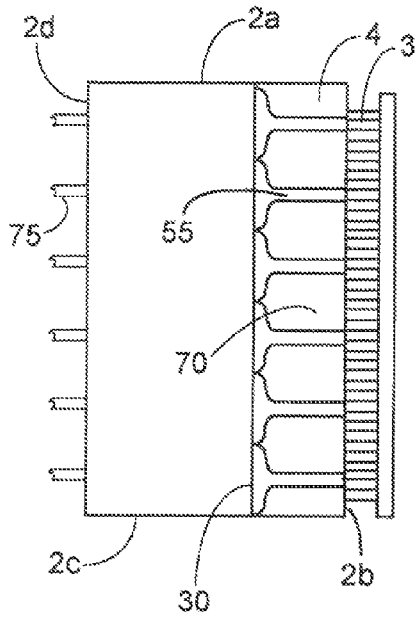
FIG. 2 is a sectional plan view of the CFB boiler of FIG. 1, viewed in the direction of arrows 2-2.

Referring now to the drawings, wherein like reference numerals designate the same or functionally similar elements throughout the several drawings and to FIGS. 1 and 2 in particular, there is illustrated a CFB reactor or boiler, having a CFB reaction chamber 1 which comprises walls 2 (2*a*, 2*b*, 2*c* and 2*d*) and an IBHX 3 immersed in a BFB 4. The CFB within the reaction chamber 1 is predominantly comprised of solids made up of the ash from combustion of the fuel 5, sulfated sorbent 6 and, in some cases, external inert material 7 fed through at least one of the walls 2 and fluidized by primary air 8 supplied through a distribution grid 10 comprising a part of the reaction chamber floor. Some solids are entrained by gases resulting from the fuel combustion process and move upward as at 15 eventually reaching a particle separator 16, such as an impact-type particle separator or U-beams, at the reaction chamber exit. While some of the solids 17 pass the separator 16, the bulk of them 18 are captured and recycled back into the reaction chamber 1. Those solids along with others 19, falling out of the upflow solids stream 15, feed the BFB 4 that is being fluidized by fluidizing medium 25 fed through a distribution grid 29 comprising another part of the reaction chamber floor. Means 27 and 28, respectively, for removing solids from the CFB 1 and BFB 4, are provided in the pertinent areas of the reaction chamber floor.

The BFB 4 is separated from the CFB 1 by an enclosure 30. The walls forming the BFB enclosure 30 may be constructed in several ways. Preferably, the enclosure walls would be comprised of fluid cooled tubes 50 (shown in FIG. 3) covered with erosion resistant material such as refractory to prevent erosion of the tubes during operation. The tubes 50 forming the enclosure 30 extend upward to an elevation allowing the required BFB 4 height within the CFB reaction chamber 1. Above the required height, the tubes 50 group to form secondary air nozzles 55. Air 60 fed to these nozzles is injected into the CFB 1 beyond the BFB 4, thus its jets 65 do not deflect streams of solids 18 and 19 from falling onto the BFB 4. Grouping the tubes 50 allows forming openings 70 through which the solids streams 18 and 19 fall onto the BFB 4. After reaching the wall 2*b*, the tubes 50 become part of the wall. Secondary air nozzles 75 on the opposite wall 2*d* are located externally to the CFB reaction chamber 1. Since no IBHX 3 is placed below the nozzles 75, their jets 80 do not cause any undesired effect.

Figure 3:
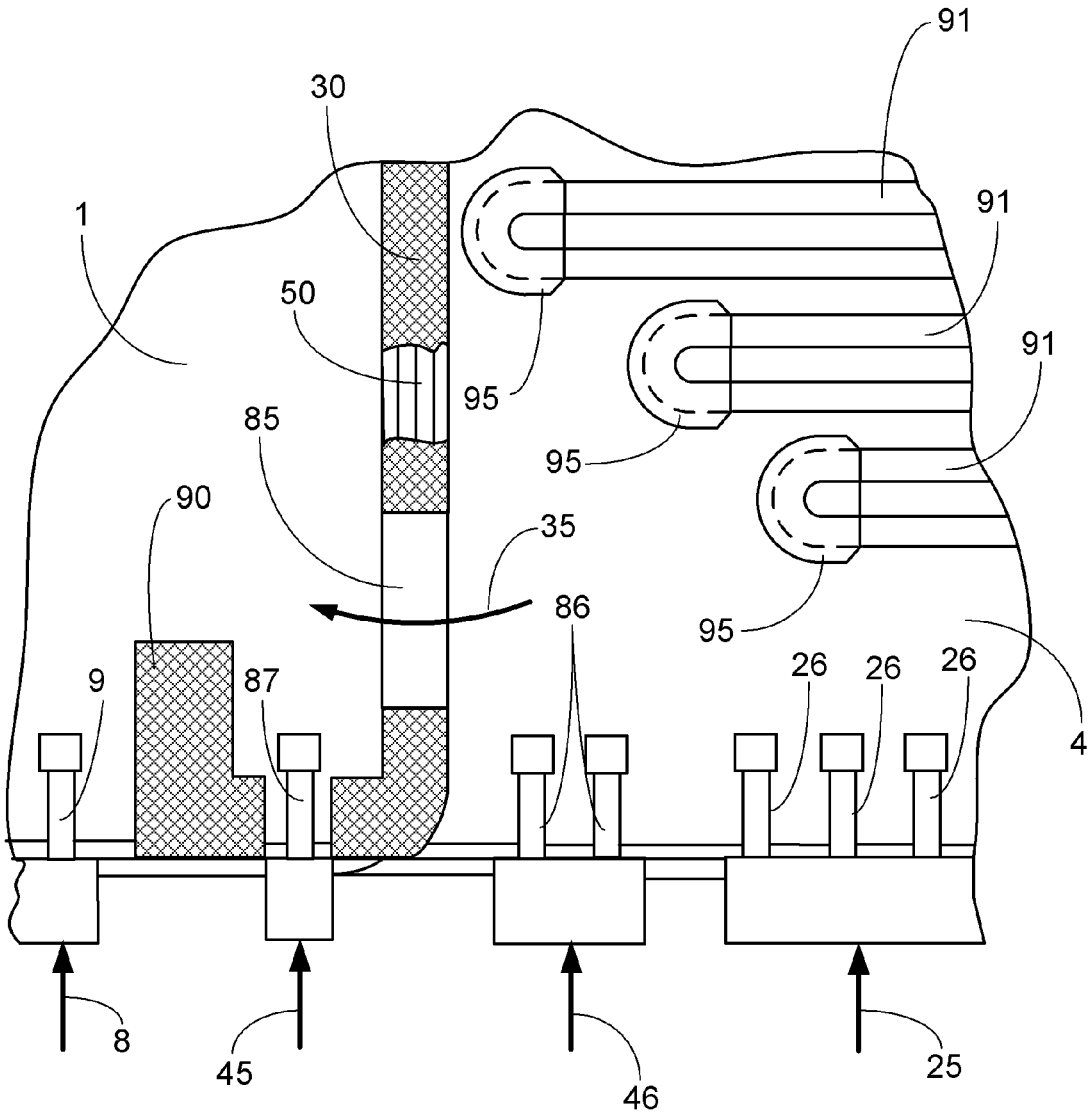
FIG. 3 is a partial sectional side view of the CFB boiler according to a first embodiment of the invention, illustrating the flow control barrier located downstream of the fluidizing means located downstream of the opening.

FIG. 3 shows an enlarged view of the area around the non-mechanical valve 40. The valve comprises an opening 85 in the enclosure 30 and independently controlled fluidizing means 86 and 87, located respectively upstream and downstream of the opening 85. These fluidizing means can be implemented as a number of bubble caps connected to a corresponding source of fluidizing medium, 46 and 45, respectively. As is well known to those skilled in the art, the most common design of a distribution grid 10, 29 would be an array of bubble caps 9, 26 fed from a corresponding source of fluidizing medium, i.e. 8 for the CFB and 25 for the BFB. A bubble cap 9, 26 is comprised of a bubble cap proper and a supply pipe, typically referred to as the stem, which interconnects the fluidizing medium with the fluidized bed. Fluidizing gas is conveyed upwardly along the stem into the bubble cap, from which it is distributed to the fluidized bed via a plurality of outlet holes. Jets of fluidizing gas exiting from the outlet holes penetrate into the CFB or BFB bed providing its fluidization gas in the area around each bubble cap. To prevent erosion of the bubble caps in the vicinity of the opening 85 by the solids flow through the opening, the tops of the bubble caps should not be higher than the bottom of the opening 85.

Figure 4:
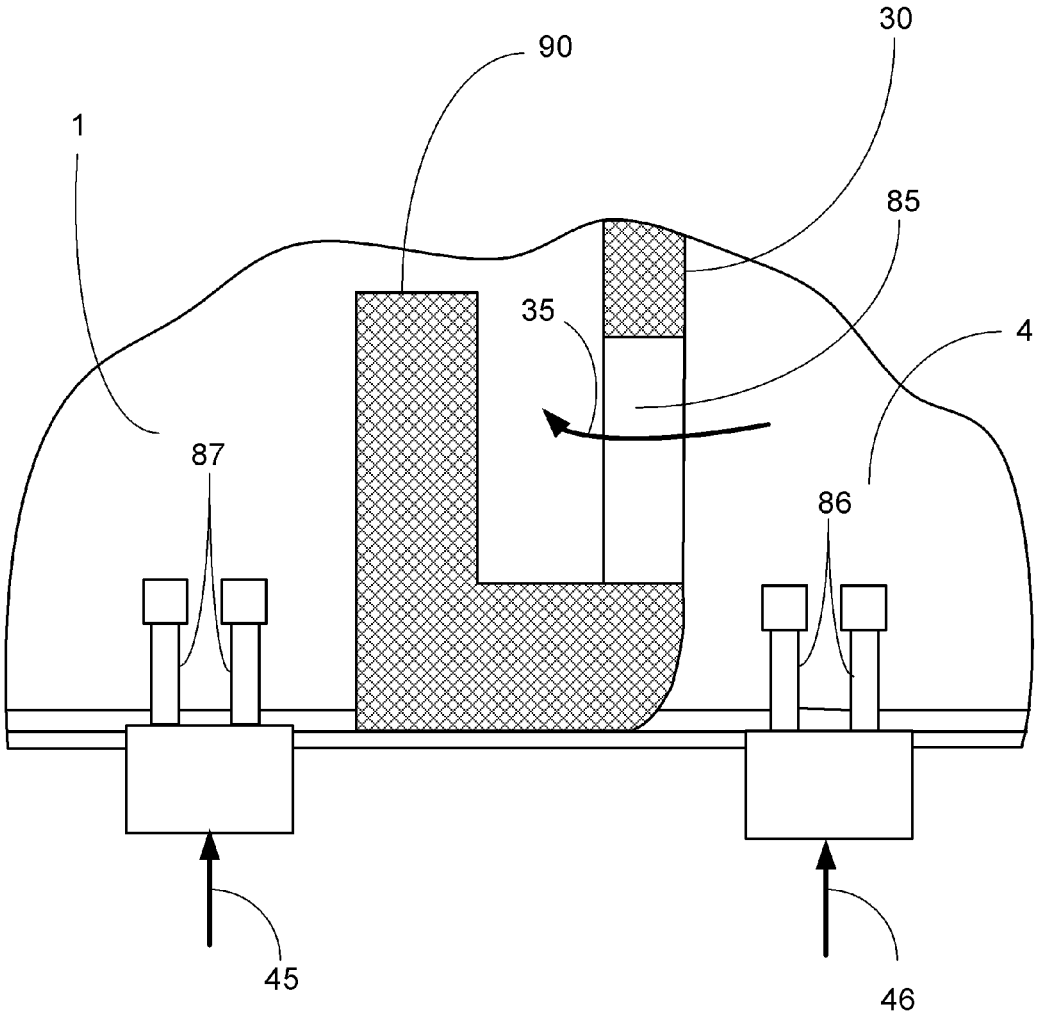
FIG. 4 is a partial sectional side view of the CFB boiler according to a second embodiment of the invention, illustrating the flow control barrier located upstream of the fluidizing means located downstream of the opening.

A flow control barrier 90 can be placed downstream of the opening 85. It provides a restriction to the solids flow through the opening 85 and also deflects the solids jet from the opening away from the bubble caps 9 or other fluidizing means in the CFB reaction chamber 1. In one embodiment of the present invention, a flow control barrier 90 is placed downstream (see FIG. 3) of the fluidizing means 87. In a second embodiment, a flow control barrier is placed upstream (see FIG. 4) of the fluidizing means 87. The top of the flow control barrier 90 will be at least as high as the bottom of the opening 85 and may be higher than the top of the opening 85. The flow control barrier will be subject to high bed temperatures and substantial erosion impact from the solids flowing through the opening 85. This requires it to be made of high temperature and erosion resistant material, e.g. ceramics or firebrick. Other options include making it of refractory-covered tubes.

The heating surface of the IBHX 3, which absorbs heat from the BFB 4, may be a superheater, reheater, economizer, evaporative or combinations of such types of heating surfaces which are known to those skilled in the art. The heating surface is typically comprised of tubes 91 which convey a heat transfer medium therethrough, such as water, a two-phase mix of water and steam, or steam. Their general erosion potential is low due to the low fluidizing velocity in the BFB 4 as well as the low velocity of solids throughput across the IBHX 3. However, in the vicinity of the opening 85 the velocity of solids traveling toward the opening increases substantially, which could increase the potential for erosion of the tubes 91. In order to reduce or prevent erosion of the tubes 91, it is thus preferable for them to be arranged so that they are not in the vicinity of the opening 85 (as shown in FIG. 3). Expected erosion rates can be estimated based upon an evaluation of the local solids velocity in the vicinity of the opening 85 (as determined by the volumetric discharge rate through the opening 85), as well as upon a consideration of the erosive characteristics of the solids. Based upon the erosion rate that can be tolerated, and the estimated erosion rate determined using the principles described above, the tubes 91 can be located to reduce erosion. Thus, as shown in FIG. 3, in order to reduce tube erosion the ends of the lower tubes 91 in the IBHX 3 are not in the vicinity of the opening 85 since they do not extend as close to the enclosure wall 30 and opening 85 as other tubes 91 in the IBHX 3. As a further precaution, parts of the tubes 91 adjacent to the opening 85 may be protected by a layer of erosion-resistant material 95, e.g. refractory held by studs welded to the tubes 91.

Control of the solids discharge from the BFB 4 to the CFB 1 is accomplished by controlling fluidizing medium flow rates 45 and 46. Gas flow to the vicinity of the solids control valve promotes solids discharge from the lower part of the BFB 4 into the CFB 1. Independent control of these flow rates, e.g. turning them on and off in alternate cycles, allows for smoothing the solids discharge rate. Particular fluidizing medium control patterns (frequency of cycling, length of a cycle, etc.) depend on properties of the bed material and boiler operation requirements and should be established during boiler commissioning.

While specific embodiments of the present invention have been shown and described in detail to illustrate the application and principles of the invention, it will be understood that it is not intended that the present invention be limited thereto and that the invention may be embodied otherwise without departing from such principles. In some embodiments of the invention, certain features of the invention may sometimes be used to advantage without a corresponding use of the other features. Accordingly, all such changes and embodiments properly fall within the scope of the following claims.

What is claimed is:

1. A circulating fluidized bed (CFB) boiler comprising:

a CFB reaction chamber having side walls and a grid defining a floor at a lower end of the CFB reaction chamber for providing fluidizing gas into the CFB reaction chamber;

a bubbling fluidized bed (BFB) located within a lower portion of the CFB reaction chamber and being bound by enclosure walls and the floor of the CFB reaction chamber;

at least one controllable in-bed heat exchanger (IBHX), the IBHX occupying part of the lower end of the CFB reaction chamber and being surrounded by the enclosure walls of the BFB;

at least one non-mechanical valve designed to permit the control of solids discharge from the BFB into the CFB reaction chamber, the valve including at least one opening in the enclosure wall of the BFB, at least one independently controlled first fluidizing means located upstream of the at least one opening in the enclosure wall, at least one independently controlled second fluidizing means located downstream of the at least one opening in the enclosure wall, and at least one flow control barrier that is located downstream of the at least one opening in the enclosure wall, wherein the elevation of the top of the flow control barrier is at or above the elevation of the bottom of the at least one opening in the enclosure wall;

wherein the elevation of the bottom of the at least one non-mechanical valve opening in the enclosure wall being at or above the top of both of the independently controlled first and second fluidizing means.

2. The CFB boiler according to claim 1, wherein the at least one flow control barrier is located downstream of the at least one independently controlled second fluidizing means.

3. The CFB boiler according to claim 1, wherein the at least one flow control barrier is located upstream of the at least one independently controlled second fluidizing means.

4. The CFB boiler according to claim 1, wherein the at least one flow control barrier is made of an abrasion resistant material.

5. The CFB boiler according to claim 1, wherein the at least one flow control barrier is made of refractory-covered tubes.

6. The CFB boiler according to claim 1, wherein the at least one IBHX is selected from one or more of a superheater, a reheater, an economizer or an evaporative surface.

7. The CFB boiler according to claim 1, wherein tubes of the at least one IBHX are arranged so that they are not in the vicinity of the at least one opening in order to reduce erosion of the tubes.

8. The CFB boiler according to claim 1, wherein the tubes of the at least one IBHX are protected by a layer of erosion-resistant material formed on the surface of the tubes in the vicinity of the at least one opening.

9. A circulating fluidized bed (CFB) boiler comprising:

a CFB reaction chamber having side walls and a grid defining a floor at a lower end of the CFB reaction chamber for providing fluidizing gas into the CFB reaction chamber;

a bubbling fluidized bed (BFB) located within a lower portion of the CFB reaction chamber, the BFB being above a grid for providing fluidizing gas into the BFB, and being bound by enclosure walls and the floor of the CFB reaction chamber;

at least one controllable in-bed heat exchanger (IBHX), the IBHX occupying a lower part of the CFB reaction chamber and being surrounded by the enclosure walls of the BFB; and at least one non-mechanical valve designed to permit the control of solids discharge from the BFB into the CFB reaction chamber, the valve including at least one opening in the enclosure wall of the BFB, at least one independently controlled first fluidizing means located upstream of the at least one opening in the enclosure wall, at least one independently controlled second fluidizing means located downstream of the at least one opening in the enclosure wall, wherein the first and second independently controlled fluidizing means are separately controllable from the at least one grid;

wherein the elevation of the bottom of the at least one non-mechanical valve opening in the enclosure wall being at or above the top of both of the independently controlled first and second fluidizing means, wherein the at least one IBHX is selected from one or more of a superheater, a reheater, an economizer or an evaporative surface, and wherein the tubes of the at least one IBHX are protected by a layer of erosion- resistant material formed on the surface of the tubes in the vicinity of the at least one opening.

10. The CFB boiler according to claim 9, further comprising at least one flow control barrier that is located downstream of the at least one opening in the enclosure wall, wherein the elevation of the top of the flow control barrier is at or above the elevation of the bottom of the at least one opening in the enclosure wall.

11. The CFB boiler according to claim 10, wherein the at least one flow control barrier is located downstream of the at least one independently controlled second fluidizing means.

12. The CFB boiler according to claim 10, wherein the at least one flow control barrier is located upstream of the at least one independently controlled second fluidizing means.

13. The CFB boiler according to claim 10, wherein the at least one flow control barrier is made of an abrasion resistant material.

14. The CFB boiler according to claim 10, wherein the at least one flow control barrier is made of refractory-covered tubes.

15. The CFB boiler according to claim 9, wherein tubes of the at least one IBHX are arranged so that they are not in the vicinity of the at least one opening in order to reduce erosion of the tubes.

16. A circulating fluidized bed (CFB) boiler comprising:

a CFB reaction chamber having side walls and a grid defining a floor at a lower end of the CFB reaction chamber for providing fluidizing gas into the CFB reaction chamber;

a bubbling fluidized bed (BFB) located within a lower portion of the CFB reaction chamber and being bound by enclosure walls and the floor of the CFB reaction chamber;

at least one controllable in-bed heat exchanger (IBHX), the IBHX occupying part of the lower end of the CFB reaction chamber and being surrounded by the enclosure walls of the BFB;

at least one non-mechanical valve designed to permit the control of solids discharge from the BFB into the CFB reaction chamber, the valve including at least one opening in the enclosure wall of the BFB, at least one independently controlled first fluidizing means located upstream of the at least one opening in the enclosure wall, at least one independently controlled second fluidizing means located downstream of the at least one opening in the enclosure wall, and at least one flow control barrier that is located downstream of the at least one opening in the enclosure wall, wherein the elevation of the top of the flow control barrier is at or above the elevation of the bottom of the at least one opening in the enclosure wall.

* * * * *